US010822908B2

(12) United States Patent
Coffey

(10) Patent No.: US 10,822,908 B2
(45) Date of Patent: Nov. 3, 2020

(54) CONTINUOUS CIRCULATION SYSTEM FOR ROTATIONAL DRILLING

(71) Applicant: Schlumberger Technology Corporation, Sugar Land, TX (US)

(72) Inventor: Scott Coffey, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/478,840

(22) PCT Filed: Jan. 17, 2018

(86) PCT No.: PCT/US2018/013942
§ 371 (c)(1),
(2) Date: Jul. 17, 2019

(87) PCT Pub. No.: WO2018/136451
PCT Pub. Date: Jul. 26, 2018

(65) Prior Publication Data

US 2020/0056441 A1 Feb. 20, 2020

Related U.S. Application Data

(60) Provisional application No. 62/447,715, filed on Jan. 18, 2017.

(51) Int. Cl.
*E21B 33/068* (2006.01)
*E21B 21/08* (2006.01)
(Continued)

(52) U.S. Cl.
CPC ..... *E21B 33/068* (2013.01); *E21B 21/08* (2013.01); *E21B 33/085* (2013.01); *E21B 34/10* (2013.01);
(Continued)

(58) Field of Classification Search
CPC ..... E21B 33/068; E21B 33/085
See application file for complete search history.

(56) References Cited

U.S. PATENT DOCUMENTS 5,022,472 A 6/1991 Bailey et al.
6,354,385 B1 3/2002 Ford et al.
(Continued)

FOREIGN PATENT DOCUMENTS

RU 2562623 C1 9/2015

OTHER PUBLICATIONS

International Preliminary Report on Patentability for the equivalent International patent application PCT/US2018/013942 dated Aug. 1, 2019.
(Continued)

*Primary Examiner* — Kristyn A Hall
(74) *Attorney, Agent, or Firm* — Jeffrey Frantz

(57) ABSTRACT

A circulation coupler for continuous or constant circulation of drilling mud during operation of a drill string, the circulation coupler comprising: a housing having an upper open end and a lower open end, wherein the housing has a port through the housing between the upper and lower ends; an upper rotating control device positioned in the upper open end of the housing, wherein the upper rotating control device comprises a bearing package and a sealing component for sealing engagement with a drill string; and a lower rotating control device position in the lower open end of the housing, wherein the upper rotating control device comprises a bearing package and a sealing component for sealing engagement with a drill string, wherein when a drill sting is positioned within the circulation coupler and engaged by the sealing components of the upper and lower rotating control
(Continued)

devices a chamber is defined within the housing between the upper and lower rotating control devices around the drill string.

18 Claims, 5 Drawing Sheets

(51) Int. Cl.

| | |
|---|---|
| ***E21B 33/08*** | (2006.01) |
| ***E21B 34/10*** | (2006.01) |
| *E21B 47/06* | (2012.01) |
| *E21B 47/07* | (2012.01) |

(52) U.S. Cl.
CPC ..... *E21B 47/06* (2013.01); *E21B 47/07* (2020.05); *E21B 2200/05* (2020.05); *E21B 2200/06* (2020.05)

(56) References Cited

U.S. PATENT DOCUMENTS

| | | | | |
|---|---|---|---|---|
| 2012/0247767 | A1* | 10/2012 | Themig ..... | E21B 21/103 166/289 |
| 2014/0166364 | A1 | 6/2014 | Blue et al. | |
| 2014/0224509 | A1 | 8/2014 | Yajure et al. | |
| 2016/0040490 | A1 | 2/2016 | Skjaerseth et al. | |
| 2018/0058169 | A1* | 3/2018 | Le ..... | E21B 33/085 |

OTHER PUBLICATIONS

International Search Report and Written Opinion for the equivalent International patent application PCT/US2018/013942 dated May 10, 2018.

* cited by examiner

CONTINUOUS CIRCULATION SYSTEM FOR ROTATIONAL DRILLING

This application claims the benefit of and priority to a U.S. Provisional Application having Ser. No. 62/447,715, filed 18 Jan. 2017, which is incorporated by reference herein.

BACKGROUND

During downhole drilling operations, an earth-boring drill bit is typically mounted on the lower end of a drill string and is rotated by rotating the drill string at the surface or by actuation of downhole motors or turbines, or by both methods. When weight is applied to the drill string, the rotating drill bit engages the earthen formation and proceeds to form a borehole along a predetermined path toward a target zone. Because of the energy and friction involved in drilling a wellbore in the earth's formation, drilling fluids, commonly referred to as drilling mud, are used to lubricate and cool the drill bit as it cuts the rock formations below. Furthermore, in addition to cooling and lubricating the drill bit, drilling mud also performs the secondary and tertiary functions of removing the drill cuttings from the bottom of the wellbore and applying a hydrostatic column of pressure to the drilled wellbore.

Typically, drilling mud is delivered to the drill bit from the surface under high pressure through a central bore of the drill string. From there, nozzles on the drill bit direct the pressurized mud to the cutters on the drill bit where the pressurized mud cleans and cools the bit. As the fluid is delivered downhole through the central bore of the drill string, the fluid returns to the surface in an annulus formed between the outside of the drill string and the inner profile or wall of the drilled wellbore. Drilling mud returning to the surface through the annulus does so at lower pressures and velocities than it is delivered. Nonetheless, a hydrostatic column of drilling mud typically extends from the bottom of the hole up to a bell nipple of a diverter assembly on the drilling rig. Annular fluids exit the bell nipple where solids are removed, the mud is processed, and then prepared to be re-delivered to the subterranean wellbore through the drill-string.

As wellbores are drilled several thousand feet below the surface, the hydrostatic column of drilling mud in the annulus serves to help prevent blowout of the wellbore, as well. Often, hydrocarbons and other fluids trapped in subterranean formations exist under significant pressures. Absent any flow control schemes, fluids from such ruptured formations may blow out of the wellbore and spew hydrocarbons and other undesirable fluids (e.g., H2S gas).

While circulating mud during drilling, several systems have been developed to allow control of the flow entering and exiting the well and to avoid kick and absorption phenomena. The flow of drilling mud entering the well may be determined by the pumping equipment, therefore the flow may be continuous and/or held constant. In standard conditions and barring any anomalies, the flow exiting the well must be equal to the flow entering the well for less than a measurement error. In many cases the exiting flow is not continuous or constant and is often not even comparable to the entering flow, despite accounting for measurement errors. This variation is due to phenomena occurring inside the well, which can sometimes compromise the outcome of the drilling operation. Several well-control systems employed in mud circulation drilling control entry and exit flows and pressures via choke valves and sensors to control and monitor the well's backpressure to predict and manage any possible hazards.

However, the standard systems do not provide control over the flows when the pumps are shut down during drill pipe loading/tripping. In this stage of drilling, there is a danger of kick phenomena because pressure is not maintained constant inside the hole, and the subsequent cycle of increases and decreases in pressure on the well walls induces hydraulic fracturing in undesired places. Furthermore, continuous circulation helps to prevent debris from falling towards the bottom of the well, but instead it keeps it moving upwards so as to prevent the drill string from getting stuck.

In addition to continuous circulation of the drilling mud, it may also be advantageous to continuously rotate the drill sting, even while additional drill pipe stands are added or withdrawn from the drill string.

BRIEF DESCRIPTION OF THE DRAWINGS

A more complete understanding of the present embodiments may be acquired by referring to the following description taken in conjunction with the accompanying drawings, in which like reference numbers indicate like features.

DETAILED DESCRIPTION

Embodiments are best understood by reference to FIGS. 1-6 below in view of the following general discussion. The present disclosure may be more easily understood in the context of a high level description of certain embodiments.

Figure 1:
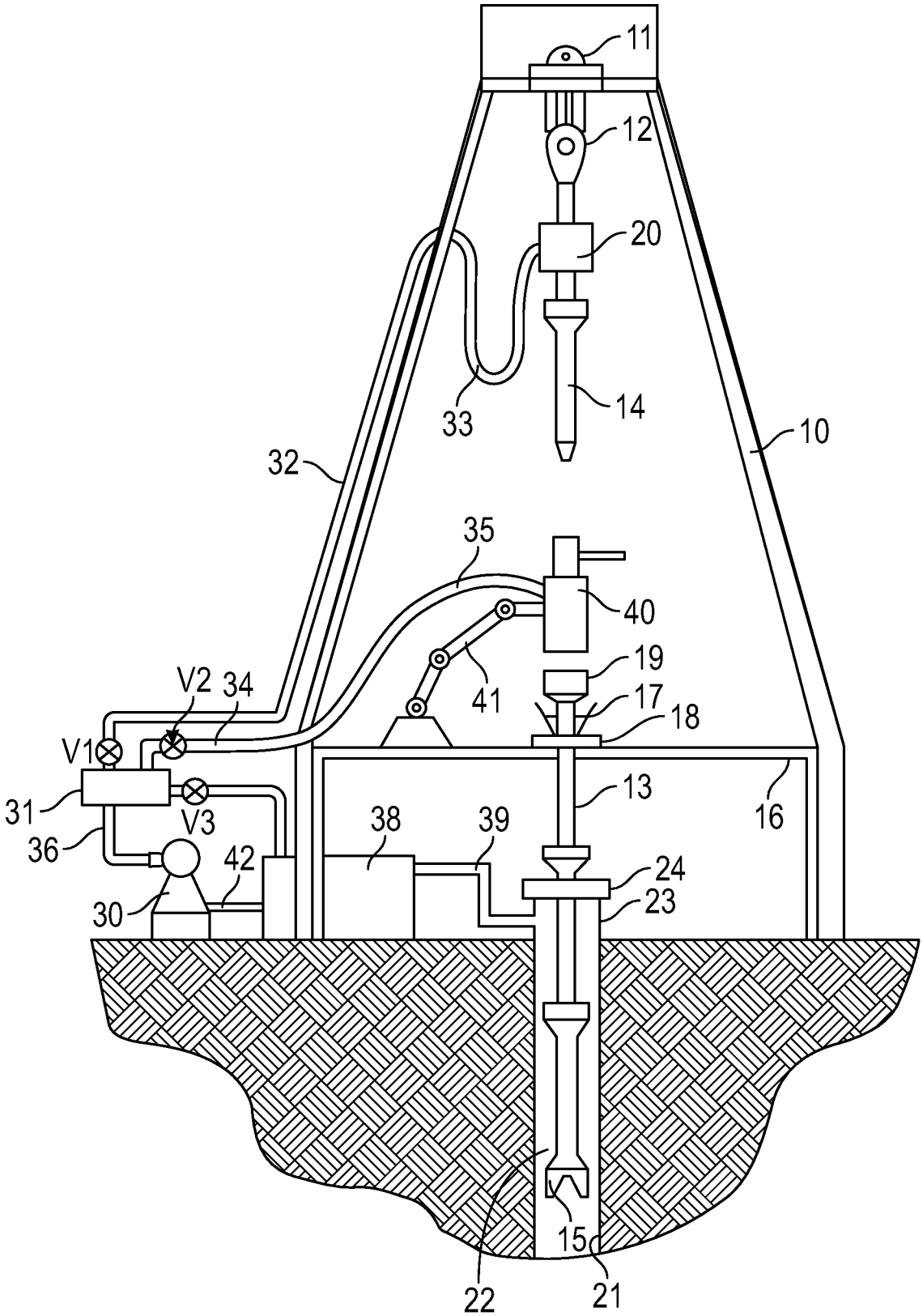
FIG. 1 illustrates a drilling system for tripping drill string with continuous or constant circulation of drilling mud and continuous rotation of the drill string.

FIG. 1 shows an embodiment of the disclosure. A drilling derrick 10 supports a crown block 11 and a travelling block 12 for making up drill pipe 14 sections of a drill string 13. A top drive 20 is suspended from the travelling block 12. A drill bit 15 is made up to the end of the drill string 13. The drill string 13 is suspended from the rig floor 16 via slips 17 in a rotary table 18 so that a stump 19 extends above the rig floor 16. The drill string 13 extends into the wellbore 21 so that there is an annulus 22 between the exterior of the drill sting 13 and the walls of the wellbore 21. A surface casing 23 extends from the top of the wellbore 21 and a rotating control device 24 is attached to the top of the surface casing 23. A blow out preventer (BOP), not shown, may be incorporated into the surface casing.

Drilling mud is circulated via a mud pump 30. The drilling mud is supplied to the drill string 13 via a diverter manifold 31. A pressure line 36 extends from the mud pump 30 to the diverter manifold 31. A line extends from the diverter manifold to the stand pipe 32, wherein the stand pipe 32 is connected to the top drive 20 via a rotary hose 33. Another line extends from the diverter manifold 31 floor pipe 34, wherein the floor pipe 34 is connected to a housing or circulation coupler 40 via a rotary hose 35. The housing or circulation coupler 40 (hereinafter "the circulation coupler 40") is supported above the rig floor 16 via an arm 41. A discharge line 37 extends from the diverter manifold 31 to a retention tank or sump 38. Drilling mud being circulated up the annulus 22 is returned to the retention tank 38 via return line 39 connected to the surface casing 23 below the rotating control device 24. Drilling mud from the retention tank 38 is supplied to the mud pump 30 via a supply line 42.

During drilling, the mud pump 30 injects drilling mud through the top drive 20 into the drill string 13. The diverter manifold is configured to only supply drilling fluid or drilling mud to the stand pipe 32. When a stand of drill pipe 14 is to be added to the drill string 13, the drill string 13 can be secured vertically, such as by the use of the slips 17. The circulation coupler 40 may be coupled to the stump 19 of the drill string 13 so as to engage a circulation sub 50 having a radial port 300 and/or a portion of the drill pipe 14. The operator may provide drilling mud to the circulation coupler 40, such as a portion of the drilling fluid being supplied from the mud pump 30. In an embodiment, a portion of the drilling mud may be provided to the circulation coupler 40 and a portion of the drilling mud may be provided to the top drive 20. As an example, a supply of drilling mud to the top drive 20 can be decreased while a supply to the circulation coupler 40 is increase, so as to maintain a constant amount of drilling fluid passing through the drill string. The circulation coupler 40 may receive all of the drilling fluid or mud and the supply to the top drive 20 may be terminated to permit connecting or disconnecting a drill pipe 14 above the circulation coupler 40. For example, during tripping in or out of the well, the circulation coupler 40 may receive the drilling fluid to provide continuous circulation while the top drive 20 is disconnected from the drill string 13. If drilling mud is no longer being supplied to the top drive 20, the top drive 20 is disconnected from the stump 19 of the drilling string 13 and another stand of drill pipe 14 is made up to the top drive 20. While the top drive 20 is disconnected from the drill string 13, the rotary table 18 may continue to turn the drill string 13 and a circulation sub 50, shown in FIG. 2. Drilling mud can be continuously supplied to the drill string 13 via the circulation coupler 40 during the process of disconnecting the top drive 20 from the drill string 13. The new stand of drill pipe 14 may then be made up to the stump 19 of the drill string 13. The operator may then decrease a supply of drilling mud to the circulation coupler 40 while a supply of drilling mud to the top drive 20 is increased, so as to maintain a constant circulation while the supply is shifted from the circulation coupler 40 to the top drive 20. Both the top drive 20 and the rotary table 18 may rotate the drill string 13 as circulation is shifted from the circulation coupler 40 to the top drive 20.

Figure 2:
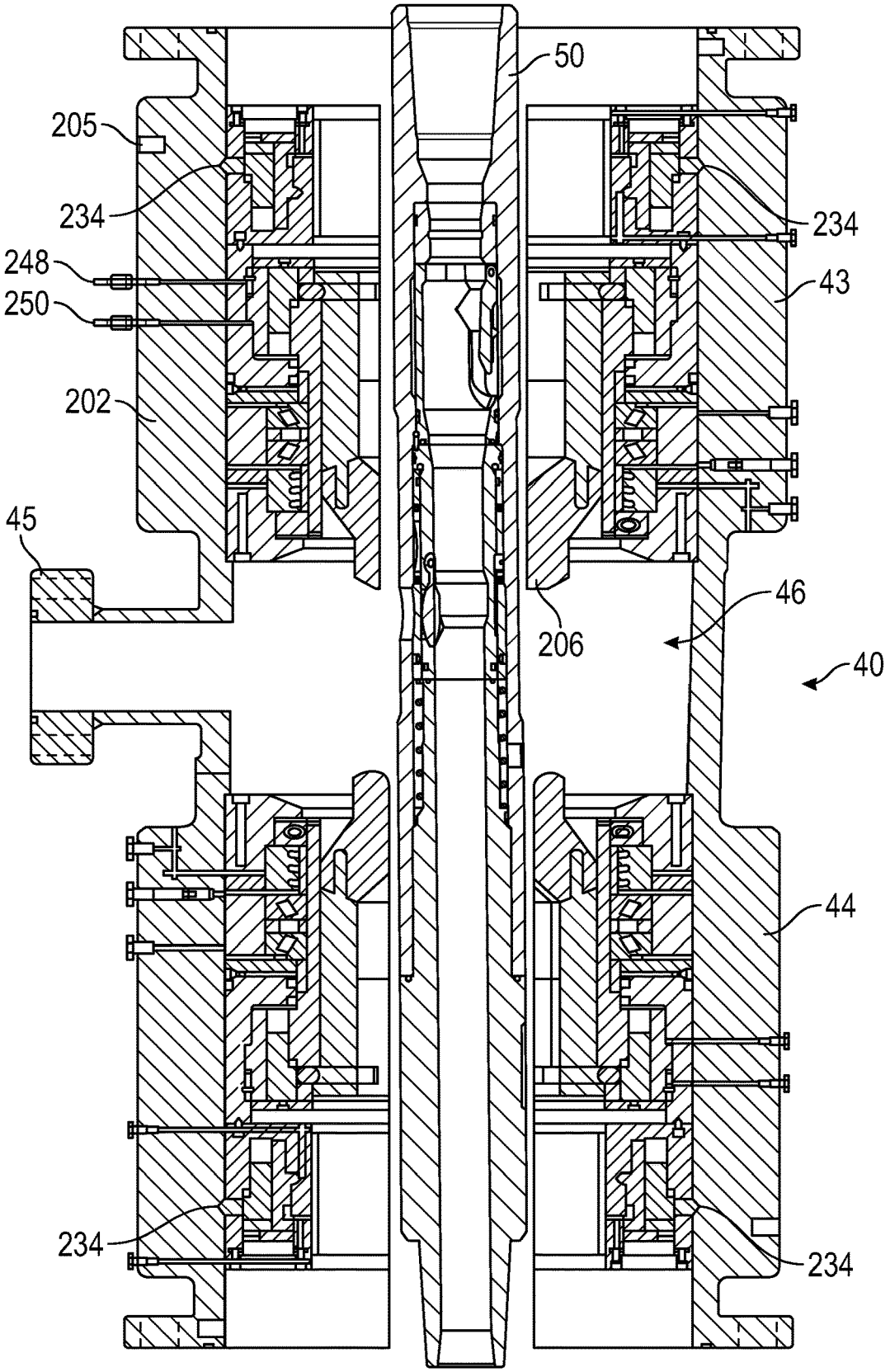
FIG. 2 shows a cross-sectional side view of a circulation coupler with RCD assemblies to define a chamber around a circulation sub.

FIG. 2 shows a cross-sectional side view of the circulation coupler 40. The circulation coupler 40 comprises two oppositely facing rotating control devices (RCD assemblies) 200. The circulation coupler 40 has as a hose coupler 45 to which rotary hose 35 (see FIG. 1) is attached. The hose coupler 45 may provide a radial port or radial opening into an interior of the circulation coupler 40. The hose coupler 45 may provide a radial opening extending radially into the circulation coupler 40 in a direction not aligned with a longitudinal axis of the circulation coupler 40. The longitudinal axis may extend vertically if connected to the drill string 13.

The circulation sub 50 is connectable to the drill string 13, and is shown inserted into the circulation coupler 40. The circulation sub 50 may be secured between each successive drill pipe 14 of the drill string 13 so that circulation may be maintained when each stand of drill pipe 14 is made up to the drill string 13. Drilling mud may be supplied to the drill string 13 by pumping it through the floor pipe 34 and rotary hose 35 (see FIG. 1) to the hose coupler 45, and into a chamber 46 within the circulation coupler 40. The drilling fluid or mud in the chamber 46 can then flow into a radial port 300 of the circulation sub 50. The upper RCD assembly 200 is sealed to the top of the circulation sub 50 and the lower RDC 200 is sealed to the bottom of the circulation sub 50. In an embodiment, the RCD assemblies 200 may be secured above and below the circulation sub 50 such that the RCD assemblies 200 contact a portion of the drill pipe 14. The RCD assemblies 200 allow for rotation of the circulation sub 50 and the drill pipe 14 while providing a seal around the radial port 300 of the circulation sub 50, the drill string 13 may be rotated by the rotary table 18 and/or top drive 20 while drilling mud is supplied to the drill string 13 through the hose coupler 45 of the circulation coupler 40. Thus, the circulation coupler 40 allows rotation of the drill string 13 and continuous circulation of drilling mud during connections of the drill string 13, such as tripping in and out of the wellbore.

Figure 3:
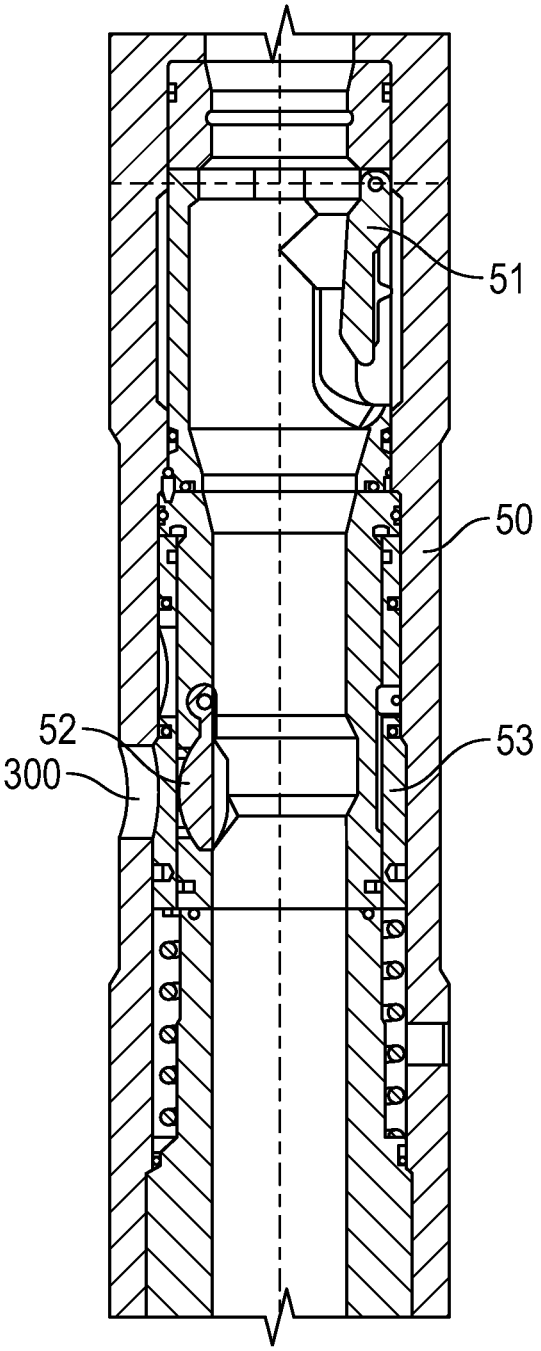
FIG. 3 shows a cross-sectional side view of a circulation sub.

FIG. 3 provides a cross-sectional side view of a circulation sub 50. The sub has an axial valve 51 and a radial valve 52. The radial valve 52 may be positioned on or about the radial port 300. The external diameter of the circulation sub 50 is similar to an external diameter of drilling pipe and can be constructed as not to preclude the passage of special equipment inside the circulation sub 50 (i.e. OD 7"—ID 2 13/16"). The two valves, the axial 51 and the radial valve 52, are movable from a retracted position to an extended position. The retracted position can permit the passage of fluids in both directions and allow components to positioned and moved through the circulation sub 50. The axial valve 51 is composed of a jacket housing a swing pattern valve closing in the axial direction of the drilling mud. The axial swing check valve 51, capable of rotating on an orthogonal pivot, can remain open by gravity when oriented vertically, for example, due to weight, centrifugal and/or hydrodynamic forces. A liner houses the axial valve 51 in such a way as not interfere with the passage of equipment inside the drilling string 13. The axial valve 51 can automatically close when the flow is provided to the radial port 300. For example, hydrodynamic forces can force the axial valve 51 closed. The axial valve 51 is lifted from the jacket and seals across the circulation cub 50 to prevent the drilling fluid or mud from moving upward away from the radial port 300. A sleeve 53 is biased in a closed position preventing access from the exterior of the circulation sub 50 to the radial port 300. At a predetermined pressure, such as pressure of the drilling fluid or mud in the chamber 46, the sleeve 53 can move to expose the radial valve 52 and the radial port 300. The radial valve 52 can open at the predetermined pressure that moves the sleeve 53 or a different pressure, such as a higher pressure. In any event, fluid pressure opens the radial valve 52 and the sleeve 53 to expose the radial port 300 and permit fluid flow into an interior of the circulation sub 50. The operation of the sliding valve 53 may be similar to that of a hydraulic piston. The sliding occurs due to difference in pressure between the chamber 46 and an interior of the circulation sub 50 at or a an interior of the sleeve 53 and/or the circulation sub 50. The sleeve 53 can slide to compresses a spring. If the pressure is balanced at the spring, such as when drilling fluid is no longer flowing into the chamber 46, the sliding sleeve 53 may slide and close to prevent fluid from flowing through the radial port 300. This pressure difference between the two regions of the valve can occur, and in some embodiments only occur, if the circulation coupler 40 surrounds the circulation sub 50 and supplies relatively high pressure drilling mud to the outside of the sliding sleeve 53. Areas subjected to external pressure can favor the closing of the sleeve 53 by having an area pushing on the spring larger than the area subject to lateral pressure.

Figure 4:
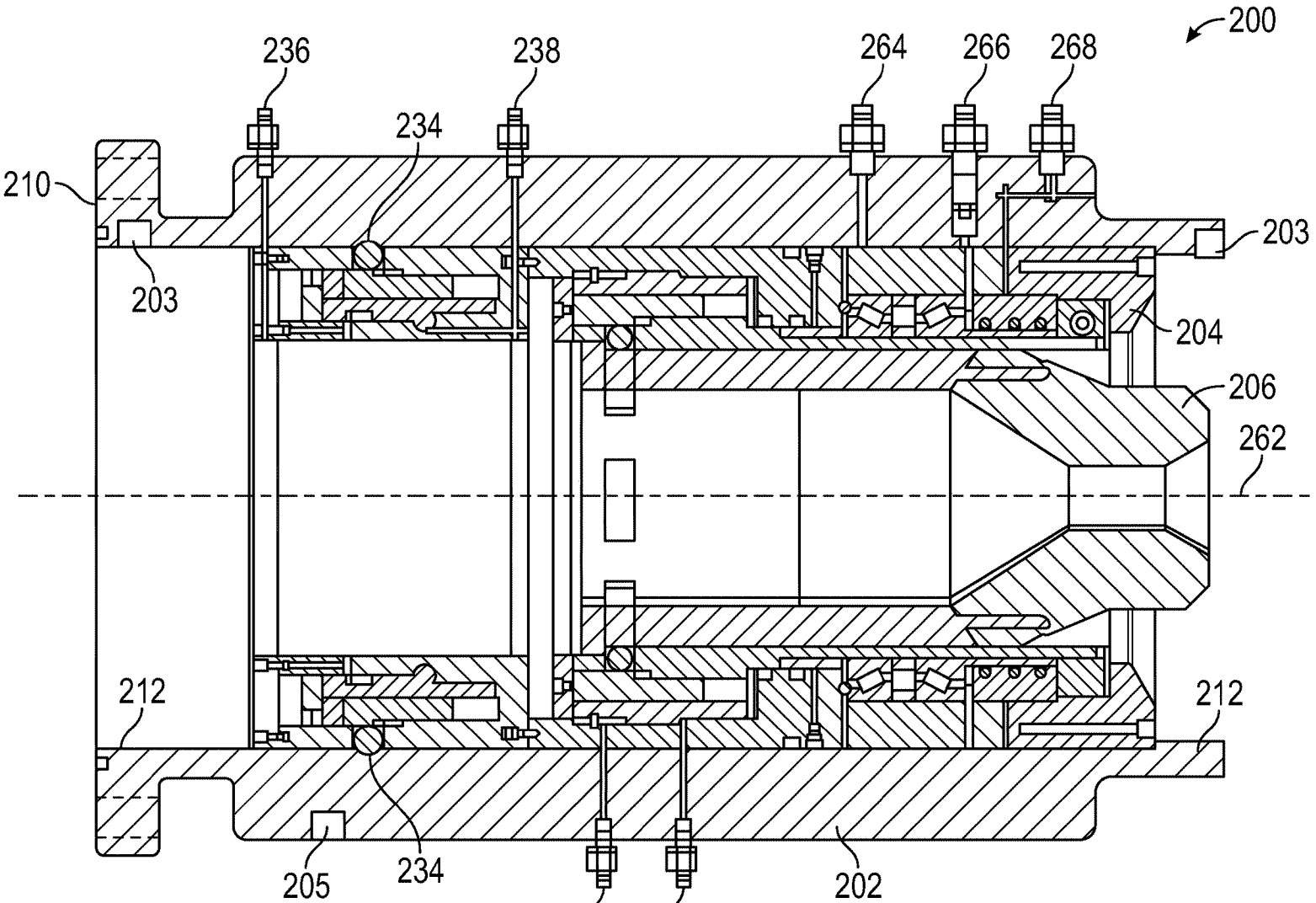
FIG. 4 illustrates a cross-sectional side view of a RCD assembly having a bearing package and a sealing component.
Figure 5:
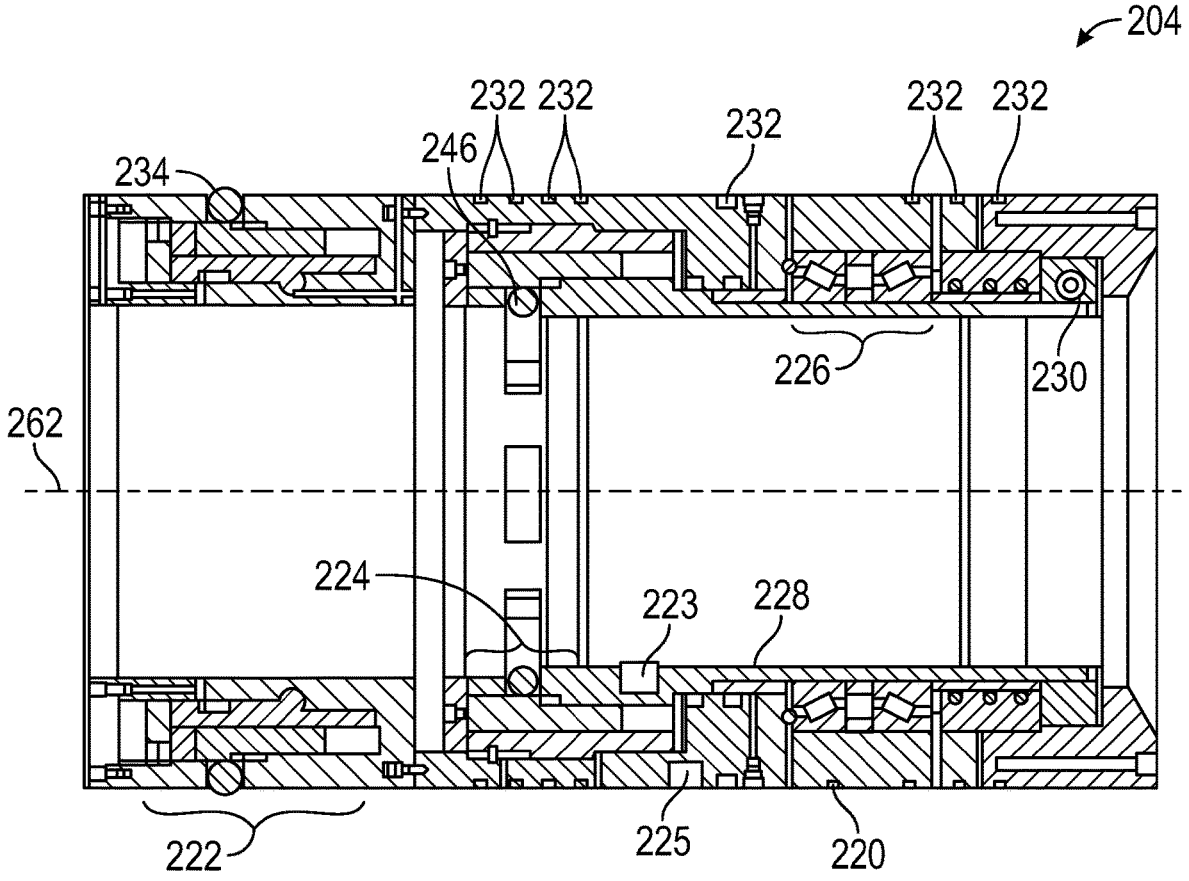
FIG. 5 is a cross-sectional drawing of a bearing package of the RCD assembly of FIG. 4.
Figure 6:
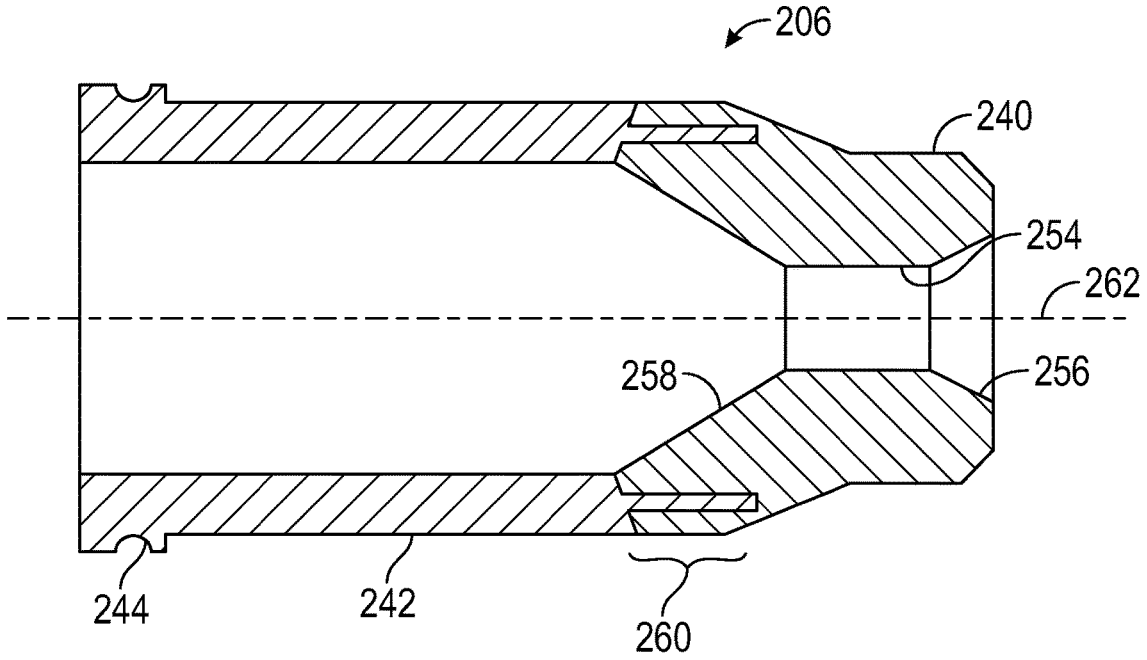
FIG. 6 is a cross-sectional drawing of a sealing component of the RCD assembly of FIG. 4.

Referring now to FIGS. 4-6, a more detailed example of an RCD assembly is provided. While the circulation coupler 40 (see FIG. 2) has two oppositely facing RCD assemblies, for simplicity only one is described with reference to FIGS. 4-6. However, it should be understood that the following description is applicable to both RCD assemblies 200.

FIG. 4 shows an RCD assembly 200 in an assembled state. The RCD 200 is composed of a housing 202, a bearing package 204, and a sealing component 206. The housing 202 includes a connection 210, for example a flange connection, for connecting to other components, for example, the remainder of a riser assembly (e.g., a slip joint). The housing 202 has an inner bore 212. One or more compartments or recesses 203 may be formed along the wall of the inner bore 212, which may hold one or more sensors (not shown). For example, recesses 203 may have temperature sensors or pressure sensors disposed therein for monitoring the temperature and/or pressure of the medium within the inner bore 212. In some embodiments, sensors may be disposed along the wall of the inner bore 212. Further, one or more compartments or recesses 205 may be formed along the outer wall of the housing 202, which may hold one or more sensors. For example, recesses 205 may have vibration sensors disposed therein for monitoring the amount of vibration the RCD assembly is being subjected to during operation. In some embodiments, sensors may be disposed on the outer wall of the housing 202 (as opposed to being disposed within a recess formed in the outer wall). In some embodiments, sensors may be positioned along two or more points on the RCD housing 202 to measure pitch and roll of the RCD assembly 200. Suitable pitch and roll sensors may include, for example, pitch and roll sensors utilizing micro electro-mechanical systems, such as Microtilt sensors, attitude sensors, or other pitch and roll sensors utilizing accelerometers oriented in the x, y, and z orientations.

Referring now to FIGS. 4 and 5 together, bearing package 204 is engaged within bore 212 of RCD 200. As shown, bearing package 204 includes an outer housing 220, a first locking assembly 222 to hold bearing package 204 within housing 202 of RCD 200, and a second locking assembly 224 to hold the sealing component 206 within the bearing package 204. Furthermore, bearing package 204 includes a bearing assembly 226 to allow an inner sleeve 228 to rotate with respect to outer housing 220 and a seal 230 to isolate bearing assembly 226 from wellbore fluids. A plurality of seals 232 are positioned about the periphery of outer housing 220 so that bearing package 204 may sealingly engage inner bore 212 of housing 202. While seals 232 are shown to be O-ring seals about the outer periphery of bearing package 204, one of ordinary skill in the art will appreciate than any type of seal may be used. One or more compartments or recesses 223 may be formed within the inner sleeve 228 to hold one or more sensors. For example, a frequency sensor, temperature sensor and/or pressure sensor may each be disposed within a recess 223 to measure and monitor selected conditions within the bearing package 204. In some embodiments, one or more sensors (not shown) may be disposed on the inner surface of the inner sleeve 228 (as opposed to within a recess formed in the inner surface). Further, one or more recesses 225 may be formed within the outer wall of the outer housing 220 to hold one or more sensors. For example, a pressure sensor (not shown) may be disposed within a recess 225 to monitor the pressure between the bearing package 204 and the housing 202 of the RCD assembly 200, which may indicate whether any failure in the seals 232 have occurred. In some embodiments, vibration sensors (not shown) may be disposed in recesses 223 formed in the inner sleeve 228 and/or in recesses 225 formed in the outer housing 220 to measure vibration of the bearing package 204.

The first locking assembly 222 may be hydraulically actuated such that a plurality of locking lugs 234 are moved radially outward and into engagement with a corresponding groove within inner bore 212 of housing 202. As shown in the assembled state in FIG. 4, two hydraulic ports, a clamp port 236 and an unclamp port 238, act through housing 202 to selectively engage and disengage locking lugs 234 into and from the groove of inner bore 212. One of ordinary skill in the art will understand that any clamping mechanism may be used to retain bearing package 204 within housing 202 without departing from the scope of the claimed subject matter. Particularly, various mechanisms including, but not limited to, electromechanical, hydraulic, pneumatic, and electromagnetic mechanisms may be used for first and second locking assemblies 222, 224. Furthermore, as should be understood by one of ordinary skill in the art, bearing assembly 226 may be of any type of bearing assembly capable of supporting rotational and thrust loads. As shown in FIGS. 4 and 5, bearing assembly 226 is a roller bearing comprising two sets of tapered rollers. Alternatively, ball bearings, journal bearings, tilt-pad bearings, and/or diamond bearings may be used with bearing package 204 without departing from the scope of the claimed subject matter.

Referring now to FIGS. 4, 5 and 6 together, sealing component 206 is engaged within bearing package 204. As shown, the sealing component 206 includes a stripper rubber 240 and a housing 242. While a single stripper rubber 240 is shown, one of ordinary skill would understand that more than one stripper rubber 240 may be used. Housing 242 may be made of high-strength steel and include a locking profile 244 at its distal end that is configured to receive a plurality of locking lugs 246 from second locking assembly 224 of bearing package 204. Second locking assembly 224 retains packing element 206 within bearing package 204 (which, in turn, is locked within housing 202 by first locking assembly 222) when pressure is applied to a second hydraulic clamping port 248. Similarly, when packing element 206 is to be retrieved from bearing assembly 204, pressure may be applied to second hydraulic unclamping port 250 to release locking lugs 246 from locking profile 244. Further, hydraulic lubricant may flow through ports 264, 266 and 268 to communicate with and lubricate bearing assembly 226.

Referring now to FIG. 6, the stripper rubber 240 is constructed so that threaded tool joints of a drill string 13 (see FIG. 1) may be passed therethrough. As such, stripper rubber 240 includes a through bore 254 that is selected to sealingly engage the size of drill pipe 13 (not shown) that is to be engaged through RCD assembly 200. Further, to accommodate the passage of larger diameter tool joints therethrough during a drill string tripping operation, stripper rubber 240 may include tapered portions 256 and 258. Furthermore, stripper rubber 240 may include upset portions 260 on its outer periphery to effectively seal stripper rubber 240 with inner sleeve 228 of bearing package 204, such that high pressure fluids may not bypass packing element 206.

As assembled, stripper rubber 240 seals around the drill string 13 and prevents high pressure drilling mud from passing between sealing component 206 and bearing package 204. Seal 230 of the bearing package 204 prevents high-pressure fluids from invading and passing through bearing assembly 226, and seals 232 prevent high-pressure fluids from passing between housing 202 and bearing package 204. Therefore, when packing element 206 is installed within bearing package 204 which is, in turn, installed within housing 202, a drill string may engage through RCD 200 along a central axis 262 such that high pressure drilling mud in the chamber 46 of the circulation coupler 40 is isolated therein. One or more pressure sensors (not shown) may be disposed along the bearing package 204, for example on the outer housing 220 or proximate the bearing assembly 226, to monitor increases in pressure, which may indicate that one or more of the seals 230, 232 have failed.

RCD assemblies 200 may be capable of isolating pressures in excess of 1,000 psi while rotating (i.e., dynamic) and 2,000 psi when not rotating (i.e., static). However, RCDs may be designed to isolate other ranges of pressures, depending on the formations being drilled and type of drilling operations being conducted. An RCD assembly 200 may include a packing or sealing element and a bearing package, whereby the bearing package allows the sealing element to rotate along with the drill string. Therefore, in using an RCD assembly, there is no relative rotational movement between the sealing element and the drill string, only the bearing package exhibits relative rotational movement. Examples of RCDs include U.S. Pat. Nos. 5,022,472 and 6,354,385, incorporated herein by reference in their entireties. In some instances, dual stripper rotating control devices having two sealing elements, one of which is a primary seal and the other a backup seal, may be used.

Referring again to FIG. 1, during drilling the drill string 13 is suspended within the circulation coupler 40. The mud pump 30 injects drilling mud through the top drive 20 connected to the stump 19 of the drill string 13. In this case, valve V1 may be open and valves V2 and V3 may be closed. When a stand of drill pipe 14 needs to be added to the drill string 13, the drill string 13 is raised and the slips 17 set. The drill string may continue to be rotated via the rotary table 18 or the top drive 20. The circulation coupler 40 is positioned on the drill string 13 so that it is around the circulation sub 50 made up to the topmost stand of drill pipe 14 in the drill string 13. The controller may then begin to close valve V1 and apply pressure to the chamber 46 inside the circulation coupler 40 by opening valve V2. The increased pressure of the drilling mud inside the chamber 46 opens the sliding valve 53 in the circulation sub 50 (see FIG. 3) so that drilling mud begins to flow into the drill string through sliding valve 53 and radial valve 52. As valve V1 is fully closed and valve V2 is fully open, the axial valve 51 of the circulation sub 50 closes so that the top drive 20 may be disconnected from the stump 19 of the drill string. The drill string 13 may continue to be rotated via the rotary table 18.

A new stand of drill pipe 14 may then be made up to the top drive 20. While the drill string is being rotated via the rotary table 18 and drilling mud is being circulated via the circulation coupler 40, the new stand of drill pipe 14 may be made up to the stump 19 of the drill string 13 via the top drive 20. Once the new stand of drill pipe 14 is connected to and become part of the drill string 13, the drill string 13 may continue to be rotated via the rotary table 18 or the top drive 20. The drill string 13 may be lifted by the top drive 20 and the slips 17 released. Drilling mud may continue to be circulated through the drill string 13 by opening valve V1 to supply drilling mud to the top drive 20, while V2 is partially closed to reduce fluid flow to the circulation coupler 40. As drilling mud begins to flow down through the internal bore of the circulation sub 50, the axial valve 51 will open and the radial valve 52 will close. Valve V3 is opened to allow the drilling mud in the circulation coupler 40, rotary hose 35 and floor pipe 34 to drain back into the retention tank 38. As the pressure is relieved from the chamber 46 in the circulation coupler 40, the drill string 13 may continue to be rotated and lowered to continue drilling the well bore 21. The drill string 13 slides down through the circulation coupler 40 during drilling operations until a new stand of drill pipe 14 is to be added to the drill string 13 and the process is repeated.

When drill string 13 is tripped out of the well bore 21, a similar process is followed, in reverse order, to allow constant and/or continuous circulation of drilling mud and continuous rotation of the drill string 13.

In the embodiment of the invention shown in FIG. 1, the circulation coupler 40 is supported by an arm 41. However, in alternative embodiments, the circulation coupler may be mounted on a blow-out preventer (BOP) stack in a modular fashion. Alternatively, the circulation coupler 40 may be integral with a blow-out preventer (BOP) stack. In still further embodiments, the circulation coupler 40 may be mounted in a marine riser above a diverter or rotating control device. In still further embodiments, the circulation coupler 40 may be mounted anywhere in a drilling system so as to enable continuous rotation of the drill string and constant and/or continuous circulation of drilling mud through the drill string.

Although the disclosed embodiments are described in detail in the present disclosure, it should be understood that various changes, substitutions and alterations can be made to the embodiments without departing from their spirit and scope.

What is claimed is:

1. An apparatus comprising:

a housing configured to receive a portion of a drill string, the housing having an axial bore therethrough extending along a longitudinal axis of the housing, the housing having a radial port extending into the axial bore in a non-parallel direction to the longitudinal axis;

a first seal within the housing and positioned at least partially above the radial port, the first seal configured to permit rotation of the drill string with respect to the housing, the first seal movable to a closed position to fluidly separate an area above the first seal from a chamber below the first seal;

a second seal within the housing and positioned at least partially below the radial port, the second seal configured to permit rotation of the drill string with respect to the housing, the second seal movable to a closed position to fluidly separate an area below the second seal from the chamber above the second seal; and a circulation sub securable to and rotatable with the drill string, wherein the first seal and the second seal are each arranged to contact an exterior of the circulation sub to define the chamber.

2. The apparatus of claim 1 wherein the radial port extends substantially perpendicular to the axial bore.

3. The apparatus of claim 1 wherein drilling fluid is provided to the radial port and into the chamber.

4. The apparatus of claim 1, wherein a portion of the circulation sub is positioned between the first seal and the second seal.

5. The apparatus of claim 1 wherein the circulation sub is rotatable with respect to the housing.

6. The apparatus of claim 5 wherein the circulation sub has a radial opening and a sleeve openable based upon drilling fluid pressure in the chamber.

7. The apparatus of claim 6 wherein the drilling fluid provided to the chamber moves the sleeve and flows into the radial opening of the circulation sub.

8. The apparatus of claim 7 wherein the circulation sub has an axial valve to prevent drilling fluid from flowing through a top of the circulation sub.

9. An apparatus comprising:

a circulation sub securable to and rotatable with a drill string;

a housing having an upper open end and a lower open end, wherein the housing has a port through the housing between the upper and lower open ends;

an upper rotating control device positioned in the upper open end of the housing, wherein the upper rotating control device comprises a bearing package and a sealing component for sealing engagement with the circulation sub; and a lower rotating control device position in the lower open end of the housing, wherein the lower rotating control device comprises a bearing package and a sealing component for sealing engagement with the circulation sub, wherein the apparatus engages the sealing components of the upper and lower rotating control devices to an exterior of the circulation sub to define a chamber within the housing between the upper and lower rotating control devices.

10. The apparatus as claimed in claim 9, wherein the upper rotating control device is latchable in the upper open end of the housing.

11. The apparatus as claimed in claim 9, wherein the lower rotating control device is latchable in the lower open end of the housing.

12. The apparatus as claimed in claim 9, further comprising a sensor of at least one parameter selected from frequency, temperature, position, pressure and vibration.

13. The apparatus as claimed in claim 9, further comprising a hose coupler in fluid communication with the port through the housing, wherein a hose is coupled to the hose coupler to supply drilling mud to the chamber through the port.

14. A method comprising:

providing a drill string having a plurality of segmented drill pipes connected successively;

connecting a circulation sub between two of the segmented drill pipes, the circulation sub having a radial port and an axial bore extending through the circulation sub;

positioning the circulation sub within a housing having a first rotatable upper seal and a second rotatable lower seal;

sealing the first rotatable upper seal and the second rotatable lower seal to the exterior of the circulation sub to define a chamber about the radial port of the circulation sub; and flowing drilling fluid into a hose coupler and into the chamber.

15. The method of claim 14 wherein the drilling fluid is flowing into the circulation sub without a drilling pipe connected above the circulation sub.

16. The method of claim 14 further comprising:

pressurizing the chamber with the drilling fluid to open the radial port of the circulation sub to flow the drilling fluid through the axial bore of the circulation sub.

17. The method of claim 14 further comprising:

rotating the circulation sub and drill string with respect to the housing.

18. The method of claim 14 wherein the flowing drilling fluid into the hose coupler and rotating the circulation sub occur without drill pipe connected above the circulation sub.

* * * * *